United States Patent [19]

Berger

[11] Patent Number: 4,809,976

[45] Date of Patent: Mar. 7, 1989

[54] APPARATUS FOR INDEPENDENTLY EXERCISING ARMS AND LEGS

[75] Inventor: Isaac Berger, New York, N.Y.

[73] Assignee: Meir Berger, Fort Lee, N.J. ; a part interest

[21] Appl. No.: 194,933

[22] Filed: May 17, 1988

[51] Int. Cl.[4] ..... A63B 21/02

[52] U.S. Cl. ..... 272/138; 272/136

[58] Field of Search ..... 272/135, 136, 138, 134, 272/142, 70–73, 96, 97, 93

[56] References Cited

U.S. PATENT DOCUMENTS

| | | | |
|---|---|---|---|
| 1,075,309 | 10/1913 | Sullivan . | |
| 1,902,694 | 3/1933 | Edwards . | |
| 3,116,062 | 12/1963 | Zinkin | 272/58 |
| 3,430,956 | 3/1969 | Borgeas | 272/96 |
| 3,524,643 | 8/1970 | Hazelitt, Sr. | 272/83 |
| 3,976,058 | 8/1976 | Tidwell | 272/134 |
| 4,550,908 | 11/1985 | Dixon | 272/130 |
| 4,684,126 | 8/1987 | Dalebout et al. | 272/134 |

FOREIGN PATENT DOCUMENTS

| | | | |
|---|---|---|---|
| 1445504 | 6/1966 | France | 272/138 |

*Primary Examiner*—Richard J. Apley
*Assistant Examiner*—J. Welsh
*Attorney, Agent, or Firm*—Kirschstein, Kirschstein, Ottinger & Israel

[57] ABSTRACT

An apparatus for independently exercising the limbs of a human exerciser includes mounting a pair of training members for independent pivoting movement along a pivot shaft mounted on a floor-mounted support. Each limb can be independently exercised by alternately extending and bending the legs at the knees or the arms at the elbows.

6 Claims, 2 Drawing Sheets

14
18
82
62b
70
50
68
62a
76
66
60b
60a
64
5
5
16
12
80
20
28
64
68
54c
58
54
54a
4
3
50
60a
62a
76
80
52c
56
52
52a
3
4
32
30
12
16
38
48
46
22
42
44
40

APPARATUS FOR INDEPENDENTLY EXERCISING ARMS AND LEGS

BACKGROUND OF THE INVENTION

1. Field of the Invention

This invention generally relates to exercise equipment and, more particularly, to an apparatus for independently exercising arms and legs of a human exerciser.

2. Description of Related Art

Equipment for simultaneously exercising both legs of a human exerciser is known. Typically, both legs are simultaneously pushed against the same resisting force. Although the known exercise equipment is generally satisfactory for its intended purpose, there are situations in which only one leg need be exercised, or in which one leg is required to be exercised differently from the other leg.

SUMMARY OF THE INVENTION

1. Objects of the Invention

It is a general object of this invention to independently exercise the legs or arms of a human exerciser.

Another object of this invention is to provide an exercising apparatus in which each leg or arm can be exercised against different resisting forces.

A further object of this invention is to provide a simple-to-use apparatus which is inexpensive to manufacture, simple in construction and durable in use.

2. Features of the Invention

In keeping with these objects, and others which will become apparent hereinafter, one feature of this invention resides, briefly stated, in an apparatus for exercising the limbs of a human exerciser. The apparatus comprises a floor-mounted support on which a seat is mounted for a human exerciser to sit upon during use of the apparatus. The support includes a pair of elongated frames. Each frame has a base portion extending along a longitudinal direction, and end portions located at opposite ends of a respective frame. The end portions supportably position the base portion of a respective frame at a predetermined elevation above a floor. The frames are interconnected and spaced apart in mutual parallelism along a direction transverse to the longitudinal direction.

In accordance with this invention, means are provided for independently exercising two limbs, either both legs or both arms, of the seated human exerciser. The means includes a pivot shaft extending transversely along a pivot axis between the frames. A pair of training members are mounted on the pivot shaft for independent pivoting movement about the pivot axis. The training members are arranged in a side-by-side relationship axially along the pivot axis. Each training member has a limb-engaging portion offset in one radial direction above the base portions of the support, and a resisting portion offset in another radial direction below the base portions of the support.

The means further comprises resistance means connected to the support and each resisting portion. The resistance means constantly urges each training member along one circumferential direction about the pivot axis, and also constantly resists movement of each training member in an opposite circumferential direction about the pivot axis.

Stop means are provided for preventing movement of each training member along said one circumferential direction past a ready position in which the seated human exerciser engages each limb-engaging portion with a respective limb and, during use, pushes each training member independently of the other along said opposite circumferential direction against the resisting action of the resistance means to an exercising position.

The novel features which are considered as characteristic of the invention are set forth in particular in the appended claims. The invention itself, however, both as to its construction and its method of operation, together with additional objects and advantages thereof, best will be understood from the following description of specific embodiments when read in connection with the accompanying drawings.

DETAILED DESCRIPTION OF THE PREFERRED EMBODIMENT

Figures 1, 4, 5:
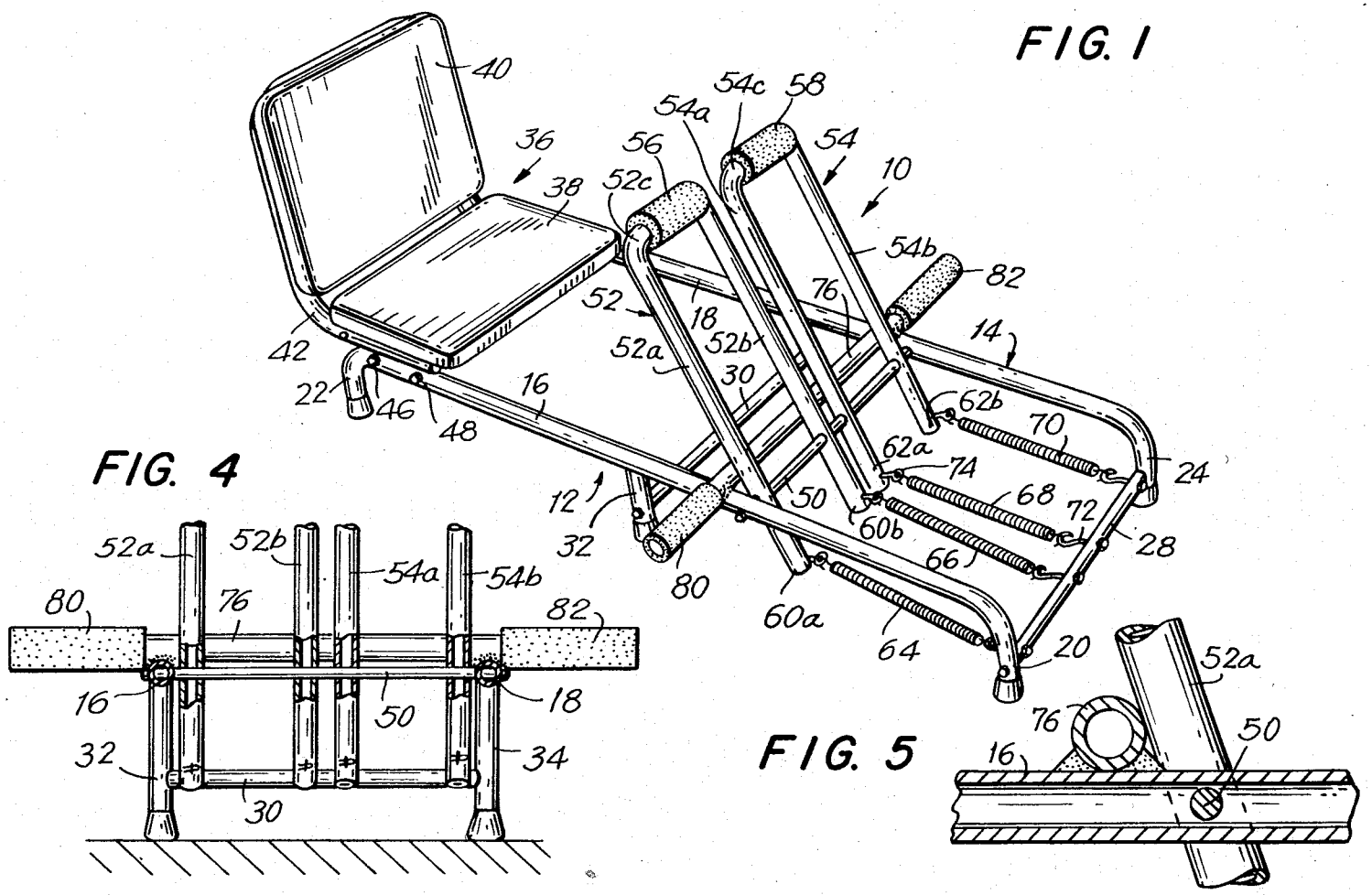
FIG. 1 is a front perspective view of an exercising apparatus according to the invention, in a ready-to-use position.
FIG. 4 is an enlarged sectional view taken on line 4—4 of FIG. 2.
FIG. 5 is an enlarged sectional view taken on line 5—5 of FIG. 3.

Referring now to the drawings, reference numeral 10 generally identifies an apparatus for exercising the limbs of a human exerciser. The apparatus includes a floor-mounted support including a pair of elongated frames 12, 14. Each frame has a base portion 16, 18 extending along a longitudinal direction, and end portions 20, 22; 24, 26 located at opposite ends of respective frames 12, 14. Preferably, the frames are constituted of tubular metal whose opposite end portions are bent to serve as legs for supportably positioning the base portions 16, 18 of the frames at a predetermined elevation above a floor. Rubber end caps are friction-tightly-fitted at the ends of the legs to prevent marring of the floor.

The frames 12, 14 are interconnected by various cross members, and are spaced apart in mutual parallelism along a direction transverse to the longitudinal direction. A first cross member 28 extends between, and is connected to, the legs 20, 24. A second cross member 30 is connected to, and extends between, additional support legs 32, 34 which are provided at a central region of the base portions 16, 18. At the end of the support opposite to the cross member 28, a seat 36, including a seat portion 38 and a back rest 40 together mounted on a seat frame 42, is connected between the frames 12, 14. During use of the apparatus, a user, schematically shown in FIG. 2 by reference numeral 44, sits upon the seat 36. The position of the seat 36 is adjustable along the longitudinal direction of the frames 12, 14 by the expedient of connecting a set of fasteners through a selected pair of aligned holes 46, 48 arranged along the longitudinal direction. Thus, if the seated human exerciser 44 wishes to sit further away from the cross member 28, two fasteners, one for each side of the support, are connected to opposed holes 46 formed through the frames and the seat frame 42. If the seated exerciser wishes to adjust his position closer to the cross member 28, then it is merely necessary to remove the aforementioned fasteners from opposed holes 46, and move the position of the seat 36 forwardly toward the cross member 28 until the holes in seat frame 42 are aligned with opposed holes 48 in the frames 12, 14. Thereupon, insertion of the fasteners into opposed holes 48 will fix the location of the seat 36 in the desired position.

In accordance with this invention, a pivot shaft 50 extends transversely along a pivot axis between the frames 12, 14 in a central region of the support. A pair of training members 52, 54, each of U-shaped configuration, are mounted on the pivot shaft 50 for independent pivoting movement about the pivot axis. As best shown in FIG. 1, the training members 52, 54 are arranged in a side-by-side relationship axially along the pivot axis.

Each training member preferably has two arms **52*a*, 52*b*; 54*a*, 54*b* between which bars 52*c* and 54*c* are interconnected. Tubular sleeves 56, 58 of yieldable material, e.g. rubber, surround bars 52*c*, 54*c* and serve as convenient limb-engaging support portions. These limb-engaging support portions are offset in one radial direction relative to the pivot axis above the base portions 16, 18 of the support. Resisting portions 60*a*, 60*b*; 62*a*, 62*b* are respectively located at the free ends of the arms 52*a*, 52*b*; 54*a*, 54*b*. These resisting portions are offset in another radial direction relative to the pivot axis, and are located below the base portions 16, 18** of the support. Preferably, the limb-engaging portions and the resisting portions extend in a common plane.

Resisting means, including a set of four coil springs 64, 66, 68, 70, are connected to the cross member 28 and each resisting portion. The coil springs are operative for constantly urging each training member 52, 54 along one circumferential direction, e.g. counterclockwise in FIG. 2, about the pivot axis and for constantly resisting movement of each training member in an opposite circumferential direction about the pivot axis. Coil springs 64, 66 are preferably provided with the same spring constant. Coil springs 68, 70 may either be provided with the same spring constant as coil springs 64, 66, or with a different spring constant. In other words, the resisting action of each training member is selected by the human exerciser and can be different for each limb to be exercised. Preferably, opposite ends of the coil springs are hooked over, and therefore easily detached from, complementary hooks 72 attached to cross member 28, and complementary eyes 74 provided on the arms of the training members.

Stop means, preferably constituted by a bar 76, is connected to, and extends between and past, the base portions 16, 18 of the frames. The bar 76 prevents movement of each training member along said one circumferential direction past a ready-to-use position shown in FIG. 1. End portions of the bar 76 which extend in opposite directions beyond the base portions 16, 18 are preferably covered with tubular rests 80, 82 of yieldable material, e.g. rubber, and serve as convenient limb supports for a limb not being exercised at a particular time.

The operation of the apparatus is believed to be self-evident. A human exerciser 44 sits in the seat 36 whose position is adjusted along the longitudinal direction in the manner described above. The position is selected such that the undersides of the exerciser's feet comfortably rest, with knees bent, on the limb-engaging portions 56, 58 in the ready-to-use position. The coil springs insure that the training members 52, 54 abut against the stop bar 76 in the ready-to-use position.

Figures 2, 3:
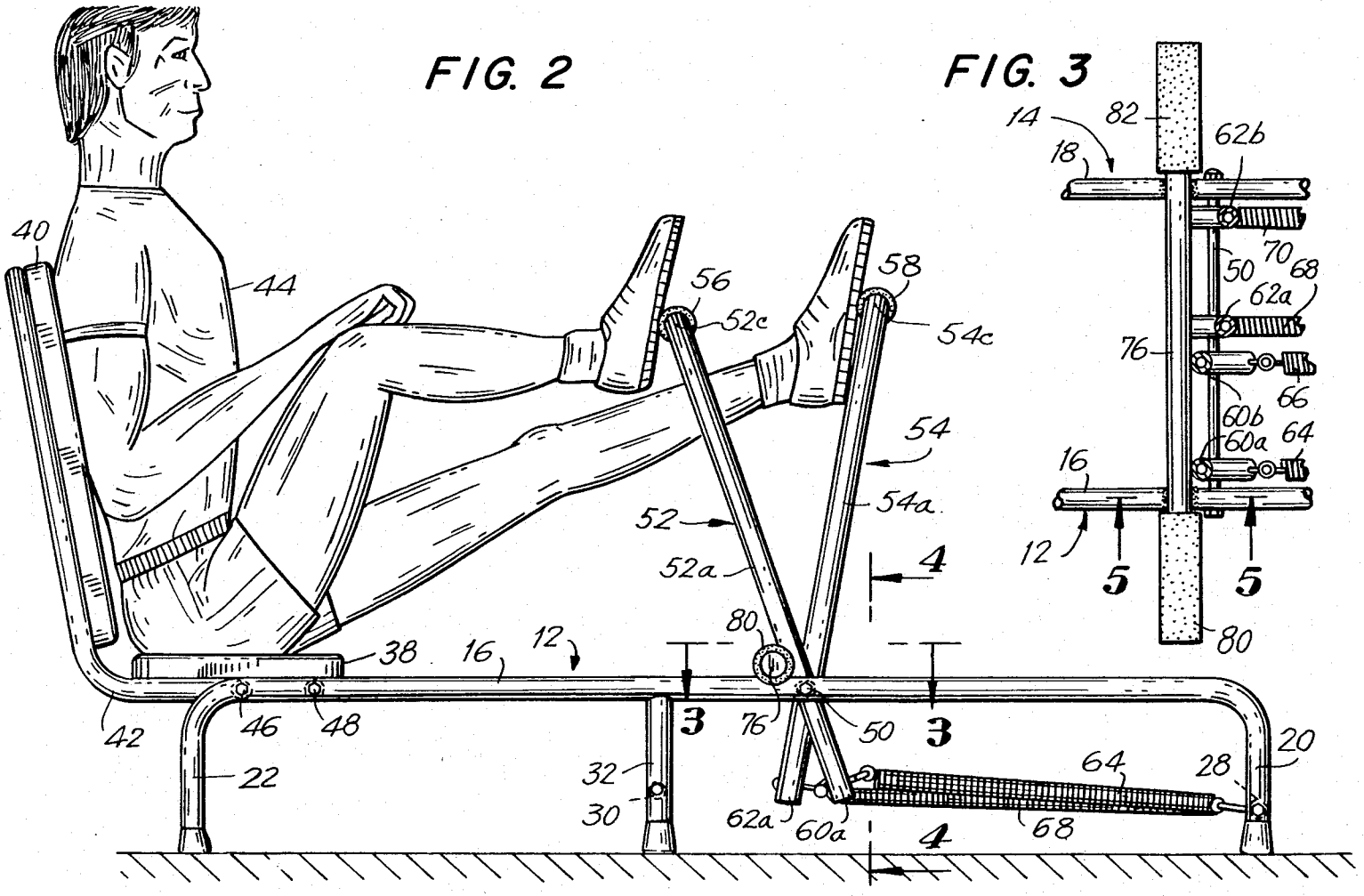
FIG. 2 is a side view of the apparatus of FIG. 1 during use.
FIG. 3 is an enlarged sectional view taken on line 3—3 of FIG. 2.

During use of the apparatus, the exerciser straightens out his knees and pushes each training member independently of the other along said opposite circumferential direction, e.g. clockwise in FIG. 2, against the resisting action of the coil springs, to an exercising position best shown in FIG. 2. Either one or both feet can push against a respective training member. Should the exerciser not wish to exercise a particular limb, then that limb can be conveniently rested on the rests 80, 82. When both legs are being exercised, the action is akin to a bicyclist pedaling, with one leg and then the other being alternately straightened and bent at the knee. Should the user desire to exercise one leg against a greater or lesser resisting force than the other leg, then the corresponding coil springs having the desired spring constant may be mounted on the support.

The training members 52, 54, as well as all of the other bars and cross members described above, may conveniently be constituted of tubular metal, e.g. aluminum or steel.

This invention is not intended to be limited to the exercising of one's legs, but can equally well be adapted to exercising one's arms by the simple expedient of having the seated human exerciser extend his arms, with elbows bent, to grasp the limb-engaging portions 56, 58 and to alternately extend and bend his arms at the elbows in the manner described above in connection with the exerciser's legs.

Of course, the disclosed apparatus can also be used to exercise both legs or arms by simultaneously straightening out or bending both legs at the knees, or both arms at the elbows.

It will be understood that each of the elements described above, or two or more together, also may find a useful application in other types of constructions differing from the types described above.

While the invention has been illustrated and described as embodied in an apparatus for independently exercising arms and legs, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims:

What is claimed as new and desired to be protected by Letters Patent is set forth in the appended claims.

I claim:

1. An apparatus for exercising the limbs of a human exerciser, comprising:

(A) a floor-mounted support including a pair of elongated frames, each having a base portion extending along a longitudinal direction, and end portions located at opposite ends of a respective frame, said end portions of a respective frame supportably positioning the base portion of the respective frame at a predetermined elevation above a floor, said frames being interconnected and spaced apart in mutual parallelism along a direction transverse to said longitudinal direction;

(B) a seat for the human exerciser to sit upon during use of the apparatus, said seat being mounted on the support; and (C) means for independently exercising two limbs of a seated human exerciser, including (i) a pivot shaft extending transversely along a pivot axis between the frames, (ii) a pair of training members, each mounted on the pivot shaft for independent pivoting movement about the pivot axis, said training members being arranged in a side-by-side relationship axially along the pivot axis, each training member having a limb-engaging portion offset in one radial direction above the base portions of the support, and a resisting portion offset in another radial direction below the base portions of the support, (iii) resistance means connected to the support and each resisting portion, for constantly urging each training member along one circumferential direction about the pivot axis, and for constantly resisting movement of each training member in an opposite circumferential direction about the pivot axis, and (iv) stop means for preventing movement of each training member along said one circumferential direction past a ready-to-use position in which the seated human exerciser engages each limb-engaging portion with a respective limb and, during use, pushes each training member independently of the other along said opposite circumferential direction against the resisting action of the resistance means to an exercising position.

2. The apparatus as recited in claim 1, wherein each training member has a generally U-shaped configuration with two arms and a bar therebetween, said arms being pivotably mounted on the pivot shaft; and further comprising a tubular sleeve of yieldable material surrounding each bar.

3. The apparatus as recited in claim 2, wherein the seat is mounted at one end region of the support, and wherein a connecting rod is connected between the frames at the opposite end region of the support, and wherein the resistance means includes two pairs of coil springs, one pair for each training member, each coil spring having one end connected to the connecting rod and an opposite end connected to a respective arm.

4. The apparatus as recited in claim 1, wherein one spring pair has a different tension than the other spring pair.

5. The apparatus as recited in claim 1; and further comprising means for adjusting the position of the seat along the longitudinal direction of the base portions.

6. The apparatus as recited in claim 1, wherein the stop means includes a cross member connected to, and extending between and past, the base portions of the frames; and further comprising tubular rests of yieldable material mounted over end portions of the cross member extending past the base portions.

* * * * *